US008037797B1

(12) United States Patent
Frank et al.

(10) Patent No.: US 8,037,797 B1
(45) Date of Patent: Oct. 18, 2011

(54) METHOD FOR BREACHING A MINEFIELD

(75) Inventors: Mark Frank, Austin, TX (US); Les H. Richards, Round Rock, TX (US); Philip L. McDuffie, Austin, TX (US); Christopher Kohl, Austin, TX (US); Thomas G. Ratliff, Austin, TX (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 776 days.

(21) Appl. No.: 11/825,693

(22) Filed: Jul. 9, 2007

Related U.S. Application Data

(60) Provisional application No. 60/830,150, filed on Jul. 10, 2006.

(51) Int. Cl.
*F41F 7/00* (2006.01)

(52) U.S. Cl. ..... 89/1.13

(58) Field of Classification Search ..... 89/1.11, 89/1.13; 102/402, 403; 86/50
See application file for complete search history.

(56) References Cited

U.S. PATENT DOCUMENTS

| | | | | | |
|---|---|---|---|---|---|
| 3,638,569 | A * | 2/1972 | Thomanek | 102/403 |
| 4,188,905 | A * | 2/1980 | Weller et al. | 114/253 |
| 4,671,162 | A * | 6/1987 | Adlam et al. | 89/1.13 |
| 4,683,797 | A * | 8/1987 | Wittbrodt | 89/1.13 |
| 4,773,298 | A * | 9/1988 | Tischer et al. | 89/1.13 |
| 4,823,672 | A * | 4/1989 | Eidelman | 89/1.13 |
| 5,183,119 | A * | 2/1993 | Wattenburg | 171/105 |
| 5,313,868 | A * | 5/1994 | Wolf | 89/1.13 |
| 5,452,639 | A * | 9/1995 | Aulenbacher et al. | 89/1.13 |
| 5,524,524 | A | 6/1996 | Richards et al. | |
| 5,614,692 | A | 3/1997 | Brown et al. | |
| 5,675,104 | A | 10/1997 | Schorr et al. | |
| 5,708,230 | A * | 1/1998 | Woodall et al. | 102/402 |
| 5,856,629 | A * | 1/1999 | Grosch et al. | 89/1.13 |
| 5,892,360 | A * | 4/1999 | Willer et al. | 324/326 |
| 5,979,290 | A * | 11/1999 | Simeone | 89/1.13 |
| 6,064,209 | A * | 5/2000 | Banerjee | 324/329 |
| 6,152,010 | A * | 11/2000 | Mixon et al. | 89/1.13 |
| 6,182,553 | B1 * | 2/2001 | Peterson | 89/1.11 |
| 2004/0007122 | A1 * | 1/2004 | Seregelyi et al. | 89/1.13 |

* cited by examiner

*Primary Examiner* — Bret Hayes
(74) *Attorney, Agent, or Firm* — Daniel J. Long; Robert K. Tendler

(57) ABSTRACT

A method for breaching a minefield comprising the step of deploying a shaped charge array from a vehicle to detonate the minefield.

21 Claims, 12 Drawing Sheets

METHOD FOR BREACHING A MINEFIELD

RELATED APPLICATIONS

This Application claims rights under 35 USC §119(e) from U.S. Application Ser. No. 60/830,150 filed Jul. 10, 2006, the contents of which are incorporated herein by reference.

FIELD OF THE INVENTION

This invention relates to armaments and more particularly to methods and apparatus for breaching minefields.

BACKGROUND OF THE INVENTION

As discussed in U.S. Pat. No. 5,675,104, minefields represent a major danger to equipment and personnel during military action. In order to permit the passage of tanks and other heavy vehicles, there is a necessity to be able to quickly breach or clear a lane through a minefield so one can bring vehicles through the minefield safely.

In the past, the traditional way to clear a lane through a minefield was to use large mechanized equipment such as plows or bulldozers to bulldoze or plow any buried mines out of the way.

In terms of the plowing technique, special blades were provided in front of the vehicle so that if mines blew up, they damaged the plow but did not damage the entire vehicle.

A second way of clearing a minefield was to deploy big-chain beaters called flails to beat the ground. The equipment necessary to deploy such beating equipment included apparatus to pick up the chains on a rotating drum and then beat the ground or pulverize the ground to set off any mines.

Typically, the chains were mounted on large vehicles out in front of the vehicle so that when the mine blew up, the mine would blow up in front of the vehicle but not directly under it.

A further approach that has been applied has been to mount a heavy roller on the front of a tank and to put a considerable load on the roller. When the roller was rolled over a landmine it was designed to set off any mines in front of the tank due to the loading of the roller. In the process the roller was destroyed. Sometimes the roller was ineffective if the pressure on the ground was insufficient to set off the mine.

Another method for clearing a minefield was to utilize individual rocket-launched explosives deployed and detonated over a minefield. A further system called the Giant Viper or MICLIC used linear bulk explosives pulled across a minefield by a rocket. In one such system a rocket motor was attached to one end of the charge and towed the charge across the minefield, whereupon it was detonated to provide overpressure waves to detonate or damage the mines so that one had a clear lane through the minefield.

It is noted that the explosive utilized in these cases was a bulk explosive and not a shaped charge, with the bulk explosive attacking the mine fuse, as opposed to the mine.

While these techniques may have been successful in the past, modern fusing technology results in landmine designs in which the fuses for the mines require sustained pressure in order to set them off. The result is that the explosive overpressure from bulk explosives will not set them off because of its transient impulse.

Thus, with respect to the above mechanized techniques, one had to deploy massive, heavy equipment that one had to bring along on the mission. The use of the heavy equipment meant that mine clearing was a relatively slow process. For instance, it could take half an hour to clear a lane of mines, with the problem being particularly difficult when exposed to enemy fire.

Moreover, with respect to rollers, tanks with plow blades and other mechanized breaching equipment, while the equipment might be effective to detonate a mine, the result is disabled equipment within the lane that one is seeking to clear.

It will be appreciated that the mines to be cleared by the technique of the subject invention are antitank mines as opposed to anti-personnel mines. The anti-personnel mines are smaller and fairly easy to trip and are designed to kill or at least maim a person. These mines may utilize either a pound or a couple of pounds of explosive.

On the other hand, antitank mines are designed to be detonated when a large vehicle or tank is driving over them. For instance, antitank mines are not designed to go off when a small vehicle goes over the mine. Also they typically have 10 to 25 pounds of explosives.

Antitank mines are deployed either at surface level on top of the ground or between four to six inches below the surface of the ground, with some being buried even deeper, for instance, to the depth of a foot.

In more recent times, the so-called Mongoose project was developed, which involved a rocket-deployed net or array of shaped-charge munitions. As described in U.S. Pat. No. 5,675,104 as well as U.S. Pat. Nos. 5,614,692 and 5,524,524, the Mongoose involved a rocket-deployed net or array full of shaped-charge munitions. The net is towed onto the minefield by the rocket such that the net settles down over the earth, with the shaped charge munitions pointing downwardly into the earth. Rather than relying on bulk explosives where one is relying on a pressure pulse to set off the mine fuse, the shaped charge attacks the mine explosive with a shaped charge jet that impacts the mine. These shaped charges deliver enough kinetic energy to the mine explosive to cause the mines to detonate rather than relying on the mine's fuse.

In one embodiment of the Mongoose system, a large number of shaped-charge munitions are carried in a net, with all pointed into the ground such that when the munitions are all simultaneously detonated, it is equivalent to having bullets spaced at regular intervals piercing the ground. If they hit a mine, then they have enough energy to cause the mine to detonate.

This type of mine-breaching system requires a vehicle-mounted launcher that launches the rocket such that it lands with the net being between 50 and 135 meters in length and at a safe standoff distance in front of the launching vehicle. The net is deployed in mid-air so that it stretches out laterally along its entire length to create a lane for follow-on vehicles.

What will be appreciated with the rocket-deployed array is that the net needs to be tight and oriented properly such that all of the individual munitions are pointed straight down into the ground and are spaced properly.

This is a point attack system in which a large number of shaped-charge munitions are each attacking a different point. Moreover, the design is such that the spacing does not leave any mines that fall in between the munitions.

The problem with all of the aforementioned systems is the weight of the system, the cost of the system and the its effectiveness.

Also important is the complexity of the system and, with respect to the net, one must provide a net having structural capability to handle the loads and the rocket motor.

SUMMARY OF INVENTION

The subject invention eliminates the complexity and problems associated with the rocket-deployed nets by eliminating the rocket motor and by using a vehicle capable of overpassing antitank mines. The deployment system described herein contemplates driving over the minefield and deploying the net, which is jettisoned from the rear of the vehicle. The vehicle itself is of a weight so as not to set off the antitank mines, or has oversize tires that run relatively flat to distribute the vehicle's weight to avoid triggering the mine fuse. In one embodiment the vehicle is robotically controlled, primarily for safety reasons, and houses the net in either a folded or collapsed position within a housing on the vehicle. The remote vehicle is deployed at the head of a lane to be cleared and has a heavy rearwardly-facing door that drops to the ground to deploy the array. Because of its weight the door pulls the net from the vehicle as the vehicle proceeds forward.

While the subject invention will be described in terms of utilizing an unmanned vehicle robotically or autonomously controlled, any vehicle that does not set off the mines may be used. However, the use of unmanned vehicles is preferred to limit danger to troops or other individuals in the vicinity.

The net containing the array of munitions is made to unfold laterally as the vehicle moves forward. Thus, as the vehicle moves forward, the net deploys and lies on the ground such that all of the munitions carried in the net are pointing into the earth and are spaced at an optimal spacing.

The net in one embodiment is such as described in U.S. Pat. No. 5,524,524 and has shaped munitions that are described in U.S. Pat. No. 5,614,692.

The material that the array is made of is an IM material or insensitive munition material, which refers to the fact that it cannot be set off by explosives or rocket propellant or cannot be set on fire.

In one embodiment of the net deployment system described herein, lateral expanders are utilized such that as the net is deployed from the robotic vehicle, it spreads out. In one embodiment, this is accomplished by a lateral-extending rod attached to the heavy back door that, when it lies on the ground, extends the net laterally. As the net is deployed from the container on the vehicle, telescopically extending poles to either side of the rear door guide and expand the net as it is pulled from the container. In one embodiment the edges of the net are provided with rings. When the net is compacted within the container on the vehicle, the rings are already in place on the telescopically extendable rods. When the back door is jettisoned from the vehicle so that it lies on the ground, the rods extend and are spaced laterally by 10 or 11 feet.

While the above describes the lateral expansion and deployment of the net of array of munitions, in a second embodiment of the subject invention, pneumatic lines are provided either throughout the net or at the edges of the net such that as the net is deployed from the container on the vehicle, gas pressure inflates the lines and causes expansion of the net as it is being deployed; or alternatively after the net has been, deployed in the collapsed position on the ground. The gas utilized is injected into the expandable bladders or lines attached to the net. Upon expansion through the introduction of gas or fluid, the net that has been deployed in collapsed position on the ground expands to its full lateral width.

Alternatively and in a third embodiment of the subject invention, the net is carried in rectilinear frames, for instance three side by side, with the outside frames being joined to the middle frame by a hinge or like device. The hinges may be provided with springs or other gas-pumping actuators for causing the panels to unfold when they are no longer constrained within the container on the vehicle as the vehicle moves forward. In one embodiment the three-panel units are folded or flaked into the container prior to deployment. Thus, the net could be considered as having two longitudinal folds, wherein each of the center panels has its associated side panels folded in on top of it. The three-part panel structure can be loaded into the container on the vehicle in an accordion fashion such that when the back door is deployed, the accordion is extended as the vehicle moves through the minefield along the lane to be breached.

Note that in one embodiment the resulting structure may be 20 to 30 panels long, with the accordion packing of the net within the vehicle container being nested together.

The panels can be deployed laterally by either spring mechanisms at the aforementioned joints or can be expanded through the utilization of the pneumatic lines described above.

Thus, the array of panels is unfolded to provide a full array width. These panels may be laterally extended by pressurizing components using gas, by using stored chemical energy, by using stored mechanical energy such as springs and the like, and with package density being minimized through the design of the panels.

Note that in the subject system the vehicle's energy in forward movement is utilized to deploy or stretch out the net across the minefield at least in one direction.

As a result of utilizing the robotic vehicle to deploy the net of munitions, one can have a high confidence in a cleared lane, combined with a rapid breaching of the minefield. The rapid breaching technology that is used is effective against all mine types, buried or surface laid. Moreover, the munition works by attacking the mine high energy, HE, fill and is effective regardless of mine fusing, casing or other factors. The subject system is considerably less complex and more robust than the rocket-deployed systems and allows for a unit cost/weight decrease.

Note that the use of the overpass vehicle as a prime mover eliminates the need for trailers or like devices, with safety concerns being greatly reduced due to the fact that the system is not launched over a manned platform.

The above system also resolves or eliminates some of the problems associated with the Mongoose project, including the firing of rockets over manned vehicles, inadvertent rocket launch, the towing of large amounts of high explosive material using manned vehicles, and the potential for the rocket to land on a manned vehicle.

As will be appreciated, what is provided is a method of creating a cleared lane through a minefield by the deployment of an array of shaped-charge munitions from an antitank mine overpass vehicle. In the deployment, the array is extended to be wider when deployed than when packaged. The system also utilizes a method for holding the shaped-charge munitions in a deployable array such that each munition is downwardly pointed. Moreover, in one embodiment the deployment is begun by utilizing a part of the storage container to begin the deployment event.

Note that at the lateral expansion described above utilizes the application of the movement of the vehicle and the force of gravity. Alternatively, the lateral expansion utilizes an active spreading mechanism.

In short, what is provided is an effective breaching using an effective neutralization technique utilizing shaped-charge munitions, with the remainder of the system being a means of putting the neutralizer on top of the mine.

In summary, what is provided is a method for breaching a minefield comprising the step of deploying a shaped charge array from a vehicle to detonate the minefield.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
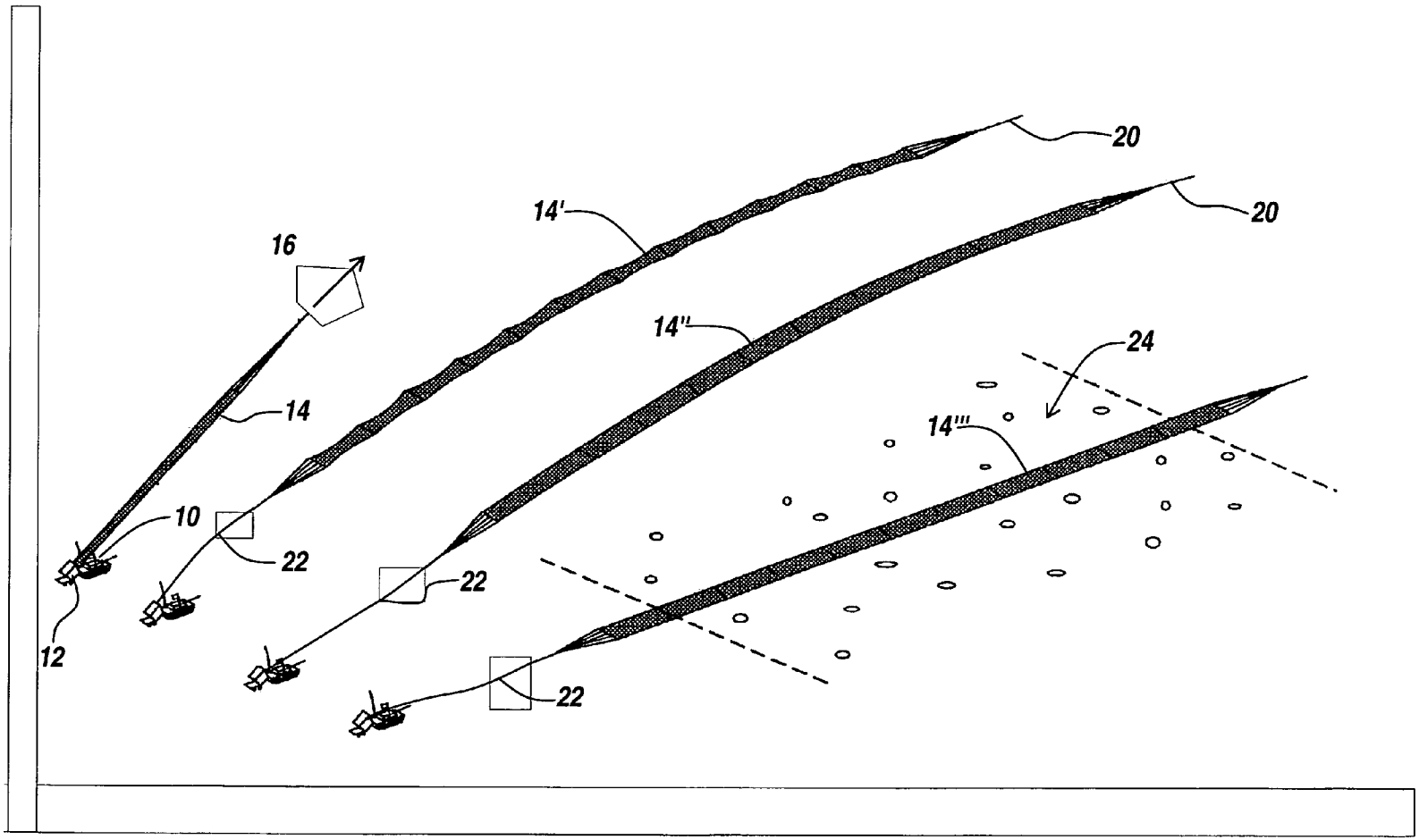
Fig. 1 (Prior Art)
FIG. 1 is a diagrammatic illustration of the prior art rocket-deployed munitions net system for breaching a minefield, including the airborne launch, unfolding and positioning of the munitions-filled net over a lane to be cleared.

Referring now to FIG. 1, in the past and as described in U.S. Pat. No. 5,675,104, what is described is a system for the aerial deployment of an explosive array for the purpose of clearing a lane in a minefield. Here a tank 10 having a rocket launcher 12 is shown launching a collapsed array of shaped munitions in a net 14 such that it is deployed in a forward direction 16.

As can be seen at 14', in flight the net is laterally collapsed upon itself and is towed out by a rocket 20 in a longitudinal direction, with a drag-generating device coupled at the opposite end of the net as it deploys.

With the net fully extended as illustrated at 14", it floats down over the minefield 24 such that it rests across the minefield as illustrated at 14'", with the net being laterally extended as well as longitudinally extended.

Upon extension and deployment over the ground through the rocket-launching technique described, the shaped charges are detonated using a cable 22 to explode the mines underneath the shaped charges.

Figure 2:
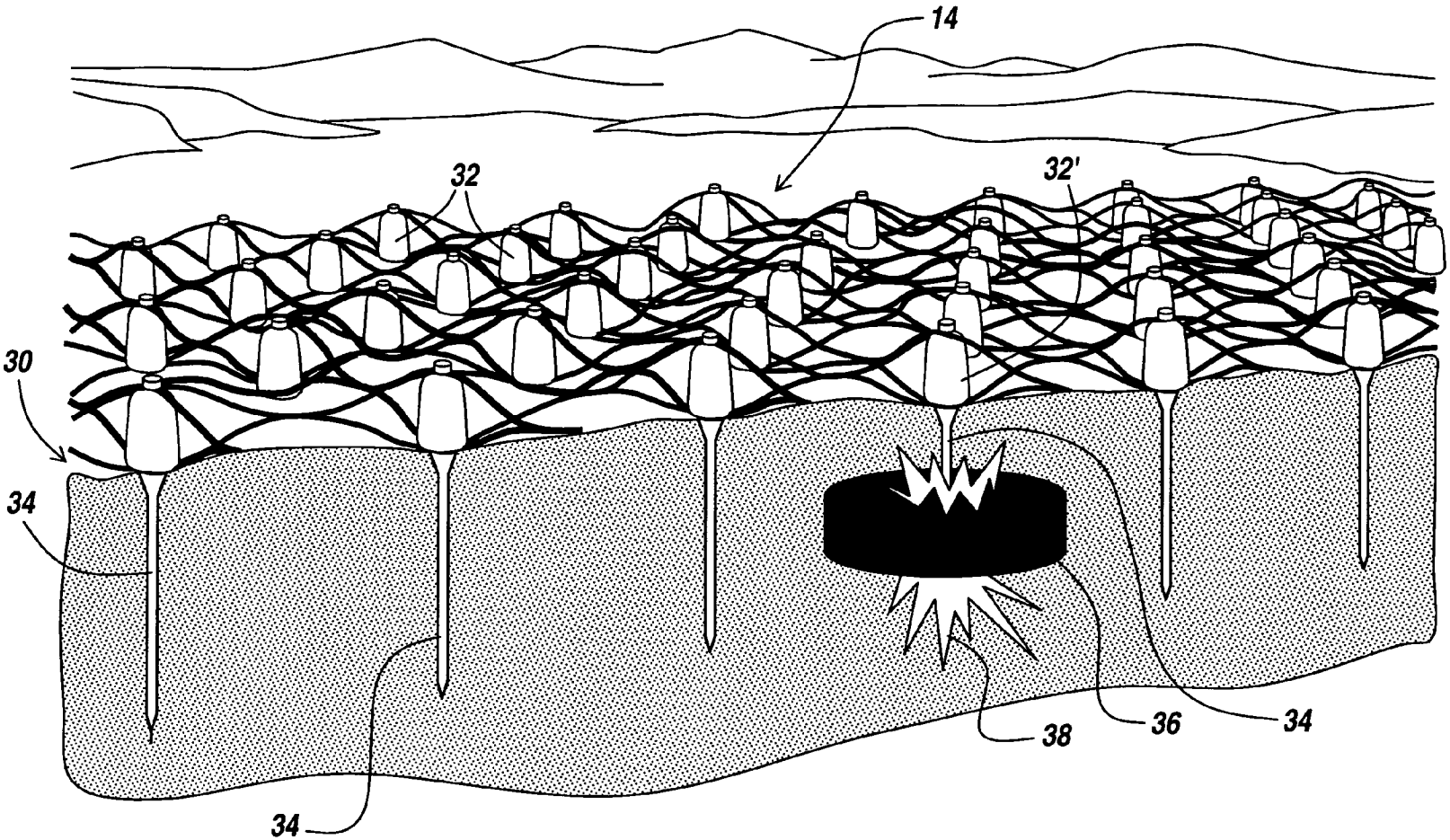
FIG. 2 is a diagrammatic illustration of the net having a plurality of shaped charges held in position by the net in which the shaped charge is utilized to detonate the high-energy explosive material of the mine situated immediately beneath the particular munition.

How this is accomplished is shown in FIG. 2 in which the net containing the array of munitions is shown deployed over the ground 30 such that the array of individual munitions 32 are oriented by the net such that the explosive direction of the charges within the munitions is pointed downwardly.

This downward explosion of the energy is shown at 34 and is in essence a pencil thin stream of molten metal.

Assuming that there is a mine 36 beneath a munition 32', then the pencil-thin explosive energy 34' detonates the high-energy explosive within mine 36, as illustrated at 38.

The explosive array 14 in one embodiment is an open configuration comprised of ropes, cords and/or straps. These members are typically conformed into a net-type structure. The net-type structure is employed to support explosives, which are distributed by the aerial deployment system.

The explosives may take the form of detonating cord run along the net structure or may include part of the net structure.

More importantly, the explosive array may include a plurality of individual explosive munitions such as in the DEMNS and ISOC systems. Preferably the munitions are jet-type munitions designed to put out a jet of metal into the ground and neutralize a mine. Typically, the detonating cord is employed to detonate the munitions. However, any suitable initiating system can be used to detonate the munitions.

Figure 3:
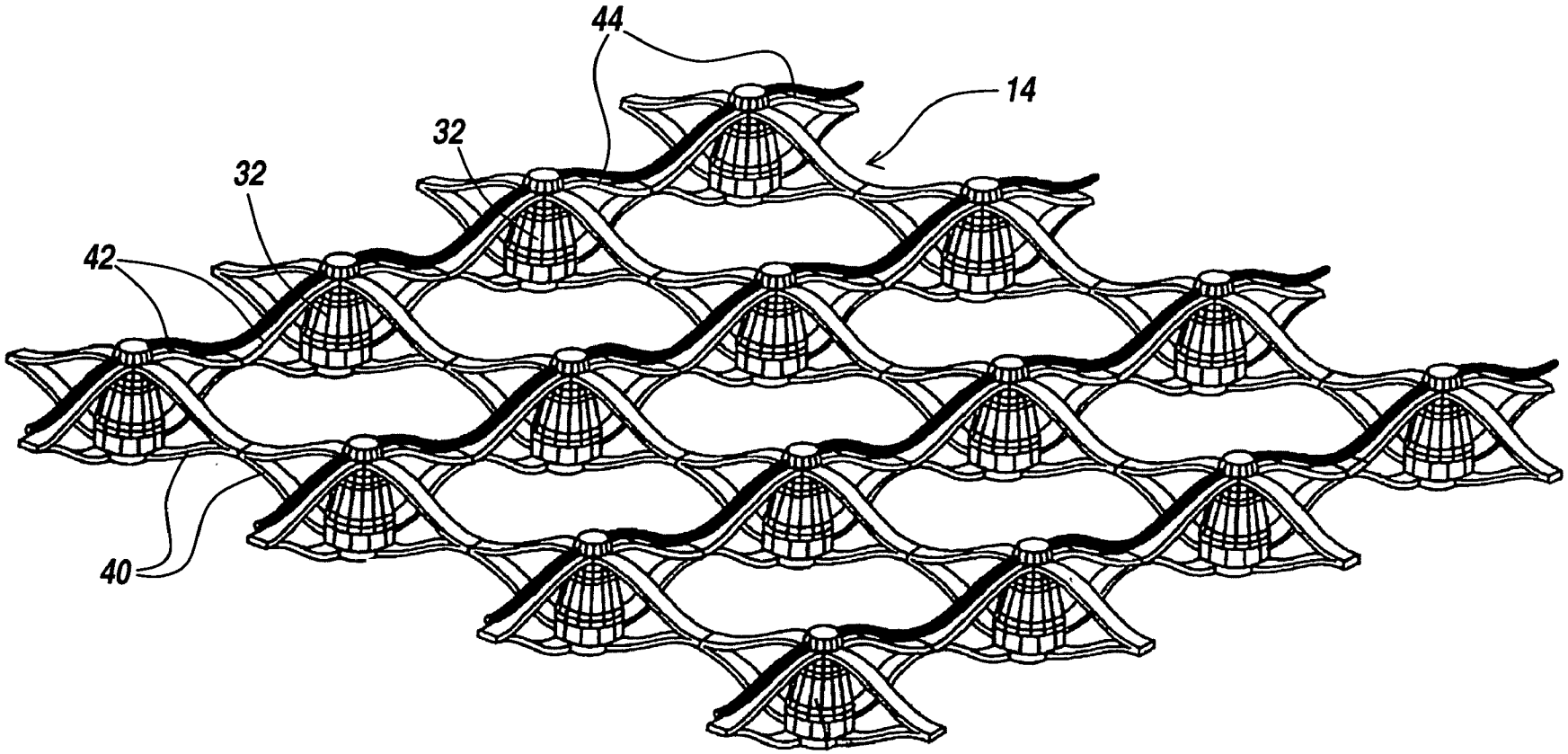
FIG. 3 is a diagrammatic illustration of a flexible net carrying a grid of shaped-charge munitions for use in breaching a minefield.

Referring now to FIG. 3, what is shown is a close-up of the array contained by net 14 in which a plurality of munitions 32 are placed in a net-type structure that includes lower strapping members 40 and upper strapping members 42. A preferred strapping material for these strapping members is a woven tubular polyester material that can be flattened into a ribbon-like strapping configuration. A suitable material for this purpose is a braided oversleeving that is commercially available from Bentley-Harris, Lionville, Pa. The sleeving is braided from high tensile strength polyester and nylon filaments. The loose weave makes the sleeving resilient and easy to handle, yet once it is fabricated into the subject system, it provides sufficient stiffness and spring rate to lie in a flat panel and exert writing movements on the munitions carried by the system. Note that a detonating cord 44 is connected to each munition. While one type of net structure is described, many other types of flexible structures to place and orient the munitions are within the scope of this invention.

Figure 4:
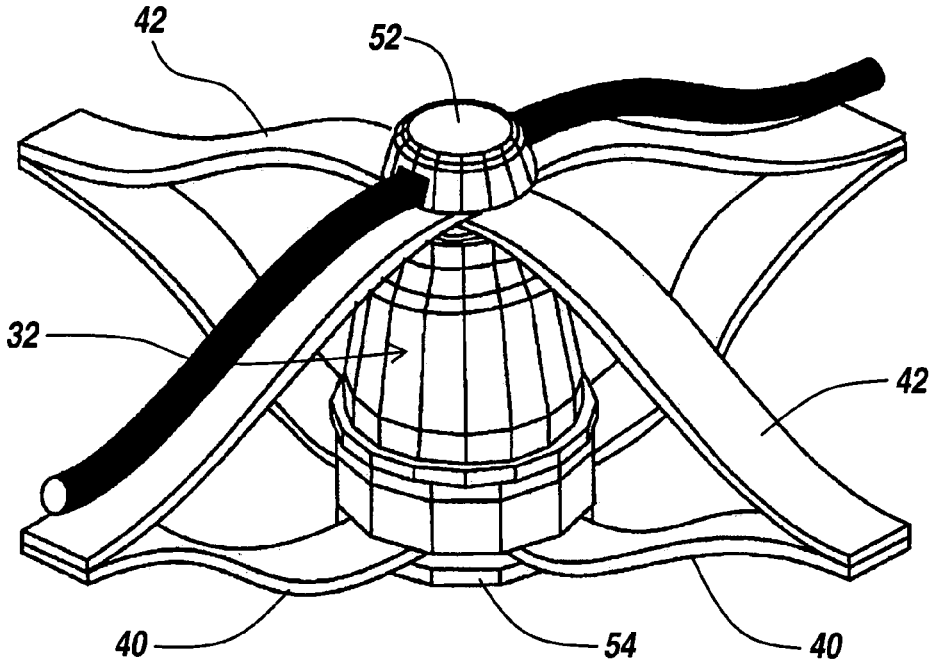
FIG. 4 is a diagrammatic illustration of one of the shaped charges carried by the net of FIG. 3.

Referring now to FIG. 4, in one embodiment munition assembly 32 is coupled to upper strapping 42, which is retained by a top cap 52. Similarly, the bottom end of the munition assembly 32 is coupled to lower strapping member 40 retained by a bottom cap 54. The upper strapping and the lower strapping are coupled to one another between munition assemblies 32 by strapping fasteners comprising caps 52 and 54. This arrangement provides a triangulated structure that effectively stabilizes the munition assemblies 32 in a downward-pointing direction.

Figure 5:
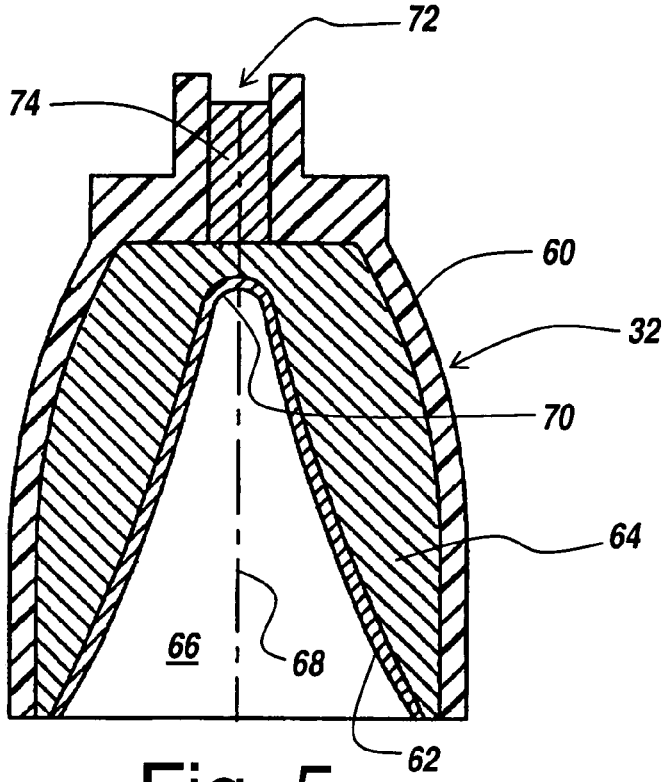
FIG. 5 is a cross-sectional view of the shaped charge of FIG. 4, illustrating a structure to provide a unidirectional, pencil-thin blast.

Referring to FIG. 5, as to the shaped-charge munition suitable for use in the subject application, the shaped-charge munition 32 in one embodiment includes a case 60, a homogenous material liner 62, and explosive 64. Case 12 defines an asymmetric, forwardly opening cavity 66 disposed about a central axis 68, with the case preferably being a polycarbonate plastic material.

The liner being asymmetrical defines a forwardly opening cavity having a closed apex 70. The liner cavity is uniformly disposed within case 12 about the central axis 20. Preferably the liner is a metal such as oxygen-free high-conductivity copper.

The explosive material is symmetrically disposed between the case and the liner. Preferably the explosive material 64 is a modern high-explosive material, such as RDX-based or HMX-based explosive material. Note that a slot 72 is provided with detonating material 74 and adapted to contact explosive material 64. Further details on the munition are available from the aforementioned U.S. Pat. No. 5,614,692.

Figure 6:
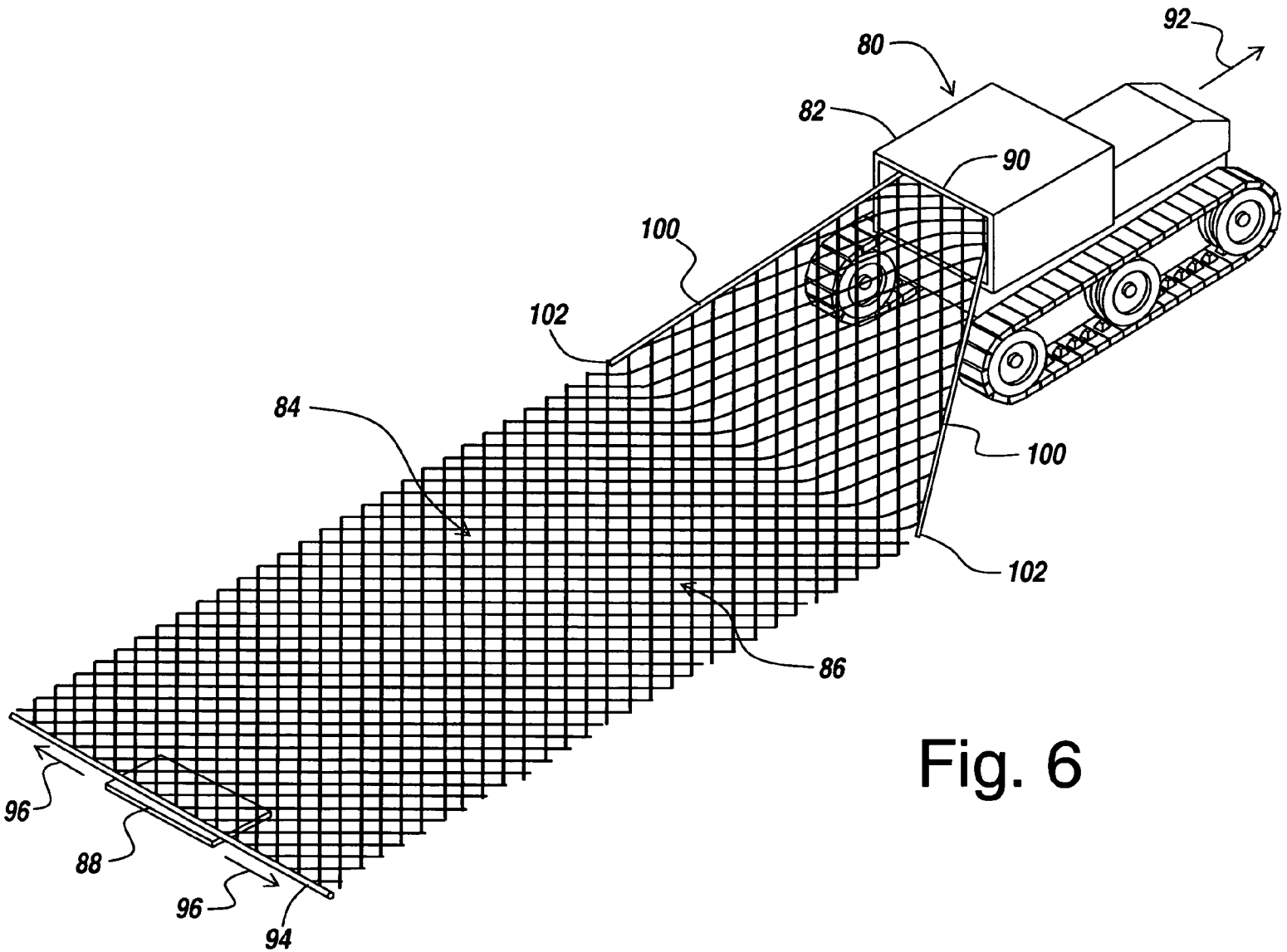
FIG. 6 is a diagrammatic illustration of the utilization of a robotically controlled vehicle from which a net is dispensed such that when the vehicle passes over the minefield lane, the net expands laterally and pays out as the vehicle proceeds down the lane.

Referring now to FIG. 6, in the subject invention an array of explosives in a net is deployed behind a pass-over vehicle 80 having a container or housing 82 in which is packed a net 84 housing an array of munitions, preferably incorporating the shaped charges described hereinbefore.

It is the purpose of the subject invention to pack an array of munitions in a container on an overpass vehicle and to deploy the array by ejecting it from its container so that it lies on the ground with the munitions directed into the ground. Because of the confines of the container on the vehicle, the lateral extent of the array when loaded and compacted into the container is shorter than the intended lateral extent of the array after it is deployed. In order to spread out the compacted array, it is the purpose of the subject invention to laterally expand the compacted array so that the lane to be cleared by the explosion of the munitions exceeds the width of the compacted array.

As will be seen, there are a number of ways of laterally expanding a compacted array so that as the array pays out from behind the vehicle and is extended longitudinally, it is also extended laterally.

There are basically three ways to effectuate lateral extension. The first way is to use guides to guide the netlike array so that as it pays out from the container on the vehicle, mechanical extenders provide for the lateral extension.

The array may also be constructed by having the array formed in a number of panels in which the panels are accordionized into the container and in which the panels are hinged to each other with torsion springs. When the accordion exits the container on the vehicle, the panels to either side of a central panel are hinged outwardly from a compacted position to a laterally extended position. While torsion springs can be used for the hinging structure, other actuators for extending the panels are within the scope of this invention.

Alternatively, a compacted array can be laterally extended using pneumatic means in which flexible tubes are expanded to laterally expand the array by expanding the net carrying the array. The expansion can use compressed gas or liquid or can be through the use of a chemical reaction that releases gas.

Regardless, the lateral expansion of the array creates a cleared lane that is wider than the container on the vehicle that contains the array.

Referring back to FIG. 6, in one embodiment the array is initially compacted and expanded by mechanical guides or spacers.

It is the purpose of vehicle 80 to pass over a lane through a minefield to be neutralized and to pay out net 84 over the ground as illustrated at 86, when a heavy door 88 is jettisoned from the exit orifice 90 of container 82. The net having the array of munitions is initially compacted within container 82 and is laterally expanded when the net is pulled out as the vehicle moves in the direction indicated by arrow 92.

Upon jettisoning of heavy door 88 from container 82, a laterally extending member 94 laterally stretches net 84 to provide a lane through the minefield that is to be neutralized by the subject system.

As such, member 94 constitutes a front lateral expander for the net such that when the net is deployed on the ground as it trails behind vehicle 80, it is laterally extended to the maximum amount possible. This extender may be a telescopic extender that after deployment may be extended outwardly as illustrated by arrows 96.

As net 84 is deployed from behind vehicle 80, in one embodiment expansion rods 100 are utilized to guide the net as it is expelled from container 82 such that the net is spread until it reaches the ends 102 of the expansion rods, which in one embodiment are resting on the ground.

It is the purpose of the expansion rods to laterally extend the compacted net such that when it reaches the ground its lateral extent will be equal to the lateral extend provided by the front lateral expander.

Figure 7:
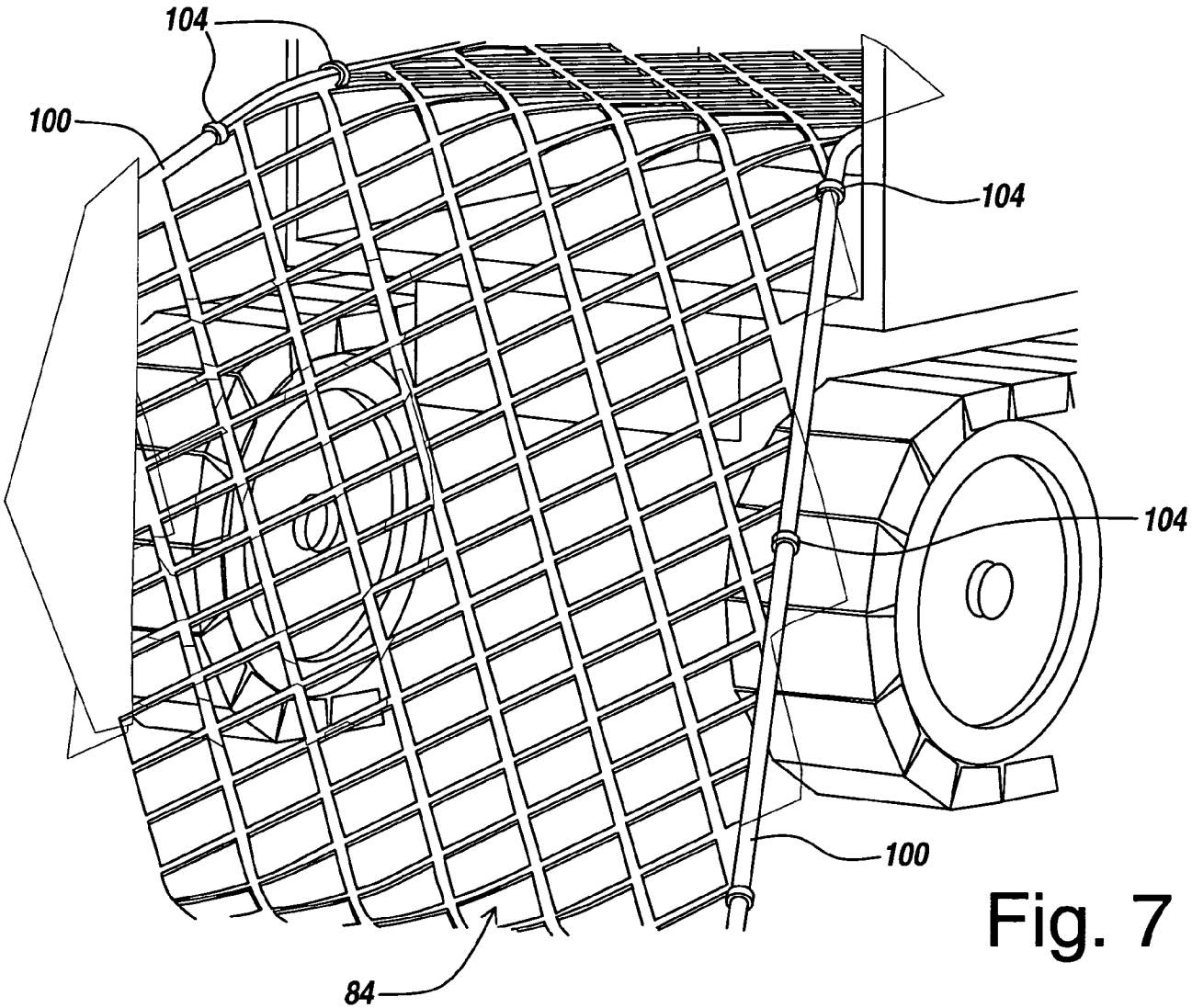
FIG. 7 is a diagrammatic illustration of the expansions rods utilized at the vehicle to expand the net as it pays out in a lateral direction so as to be able to clear an 11- to 12-foot lane.

More particularly and referring now to FIG. 7, net 84 is expanded by providing rods 100 with rings 104 attached at spaced intervals to the edges of the compacted net. As the net pays out behind vehicle 80 of FIG. 6, the rings slide down the expansion rods such that after the rear door falls to the ground the initial portion of the net is pulled out and acts as an anchor to start the deployment. Thereafter, expansion rods 100 guide the compacted net so as to stretch it out laterally until the net reaches the ground and comes off of ends 102 of the rods.

Figure 8:
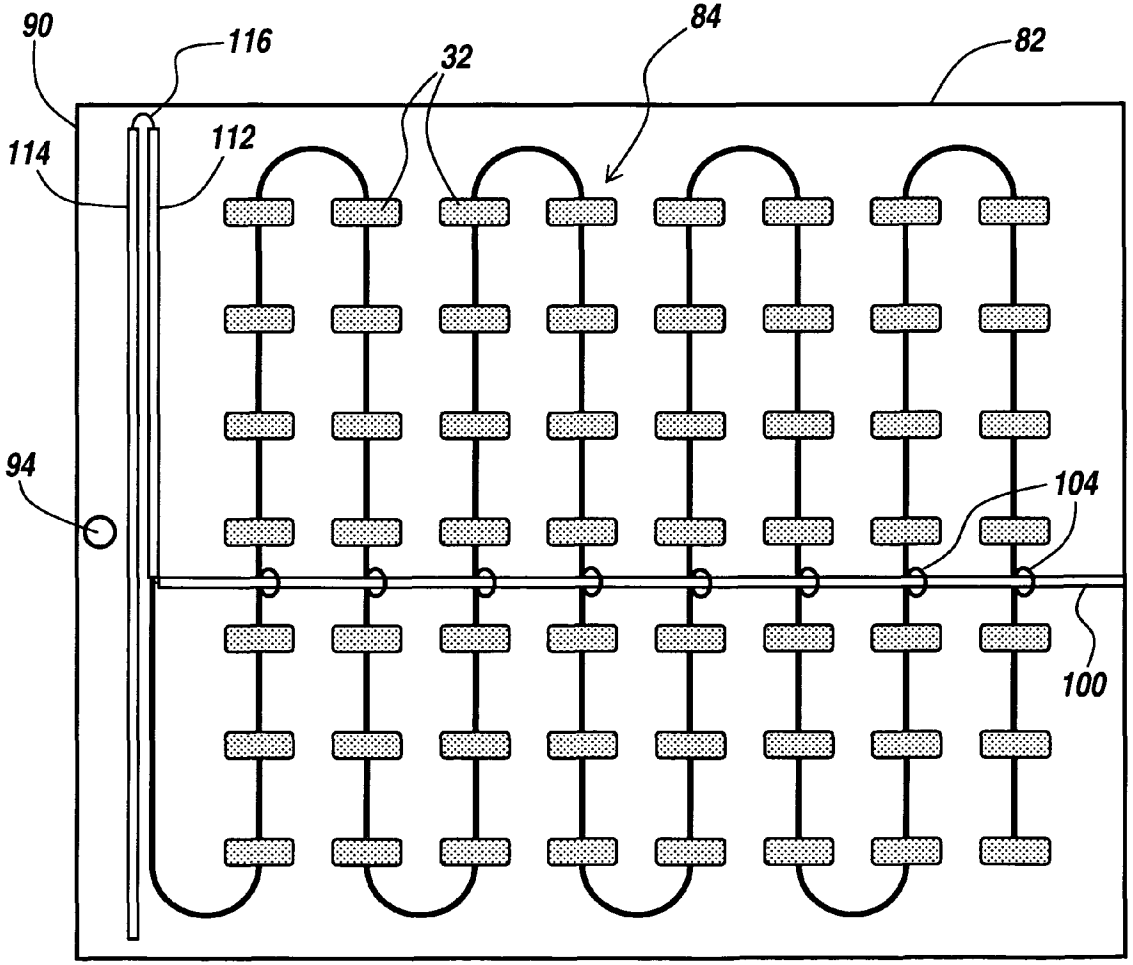
FIG. 8 is a diagrammatic illustration of the packing of an array carried in the net of FIGS. 6 and 7 in which the array is attached to expansion rods prior to deployment, with the expansion rods being spring-loaded so as to extend out and to the sides of the vehicle upon deployment, thus to guide the edges of the net in an expanded lateral configuration.

Referring to FIG. 8, how this is accomplished is as follows. It can be seen that net 84 is packaged within container 82 such that the array of munitions 32 is folded up in an accordion fashion, with the edges of the net being provided with the aforementioned rings 104 around the associated rod 100.

Here it can be seen that rod 100 is trifurcated into sections 110, 112 and 114 having an elastomeric band therein such that when the rod exits container 82 at exit orifice 90, the rod springs out and straightens out such that in the deployed position this rod is as illustrated in FIG. 6. As can be seen, the front lateral expander member 94 is shown located orthogonal to rod 100.

In operation, when the net is pulled from the vehicle, the expansion rods spring out to either side of the vehicle due to the shock cord 116.

The net result is that for a robotically or autonomously operated vehicle, the net of explosives can be deployed without having to be adjacent personnel, with the rapid deployment being the paying out of the net as the vehicle moves in a forward direction.

The lateral expansion of the net is accomplished by the front lateral expander member 94 and the lateral expansion rods 100 to provide for the requisite width of cleared lane.

Figure 9:
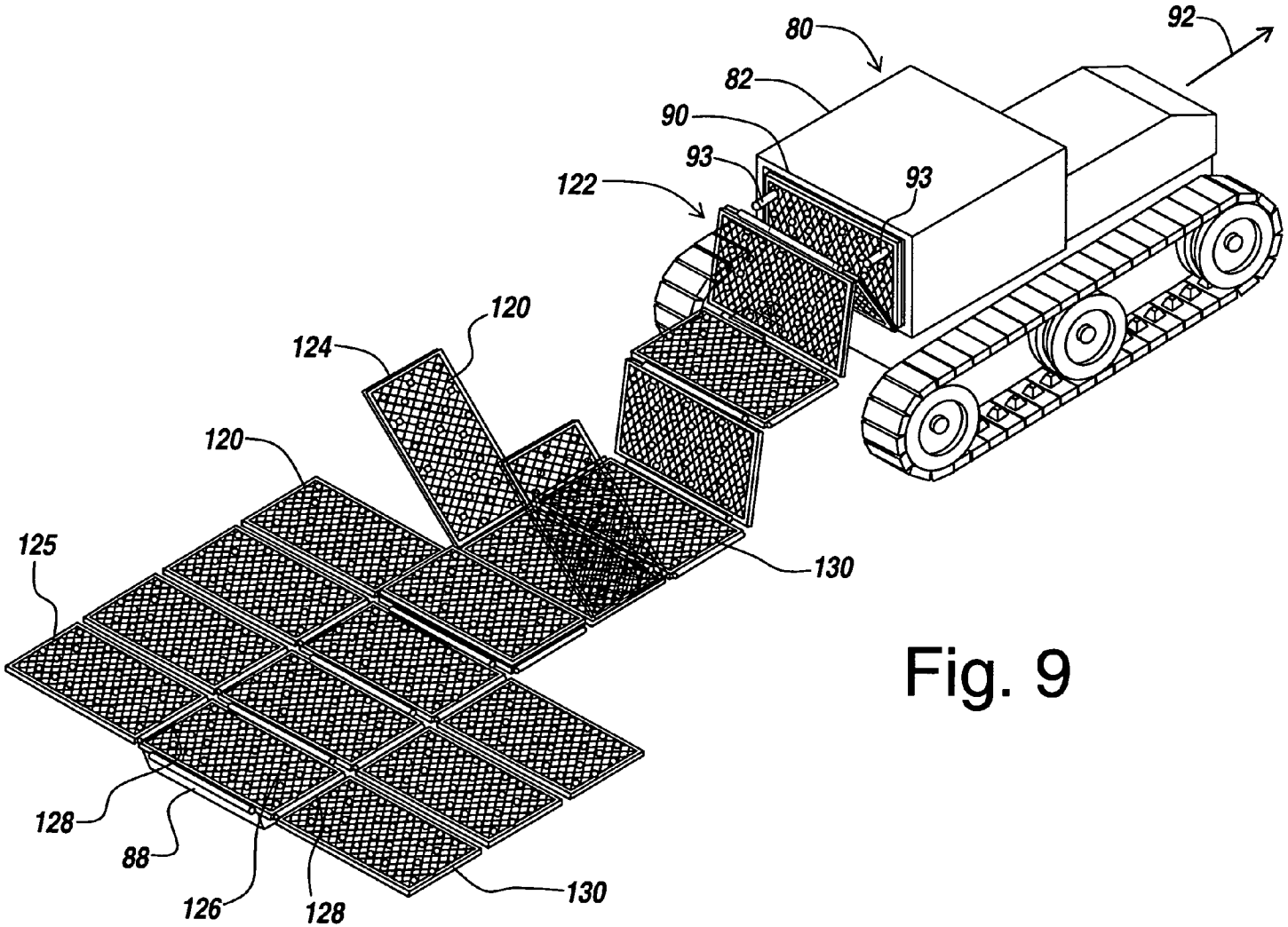
FIG. 9 is a diagrammatic illustration of a folded panel-type of array in which the net carrying the munitions is contained within a rigid framework having sides folded thereon such that, when packed in an accordion fashion within the container on the vehicle, is deployed by unfolding the accordion as the frames are dragged along behind the vehicle.

Referring now to FIG. 9, in an alternative embodiment, vehicle 80 is provided with an accordionized and hinged array of panels 120, which are housed in a accordion fashion as illustrated at 122 within container 82 on vehicle 80. Each of the munitions panels is surrounded by a frame 124. Outer frame 125 is hinged to a central panel 126 via spring-loaded hinge 128 whereas the other outer frame 130 is hinged to center panel 126 by hinge 128. As can be seen, prior to deployment side frames 125 and 130 are folded inwardly onto the associated central panel 126 from which either mechanical or pneumatic actuators unfold the panels upon deployment from aperture 90 in container 82.

Before deployment, the set of panels are stored accordionwise in container 82, with adjacent side panels being folded inwardly so as to nest adjacent the center panel for each of the lateral rows of frames.

In a manner similar to the embodiment previously described, the array of munitions provided by the framed net structure may be extracted from container 82 such that it expands in the longitudinal direction behind the vehicle as it moves in the direction illustrated by 92. Here it can be seen that door 88 is attached to central panel 26 at the edge of the explosive array.

Note that lead screws 93 co-acting with the frames can push the frames out of the container. As will be appreciated, the panel-to-panel rate of deployment is controlled by the lead screws synchronized with rate of advance of the vehicle. This eliminates any dragging of the deployed panels along the ground.

Figure 10:
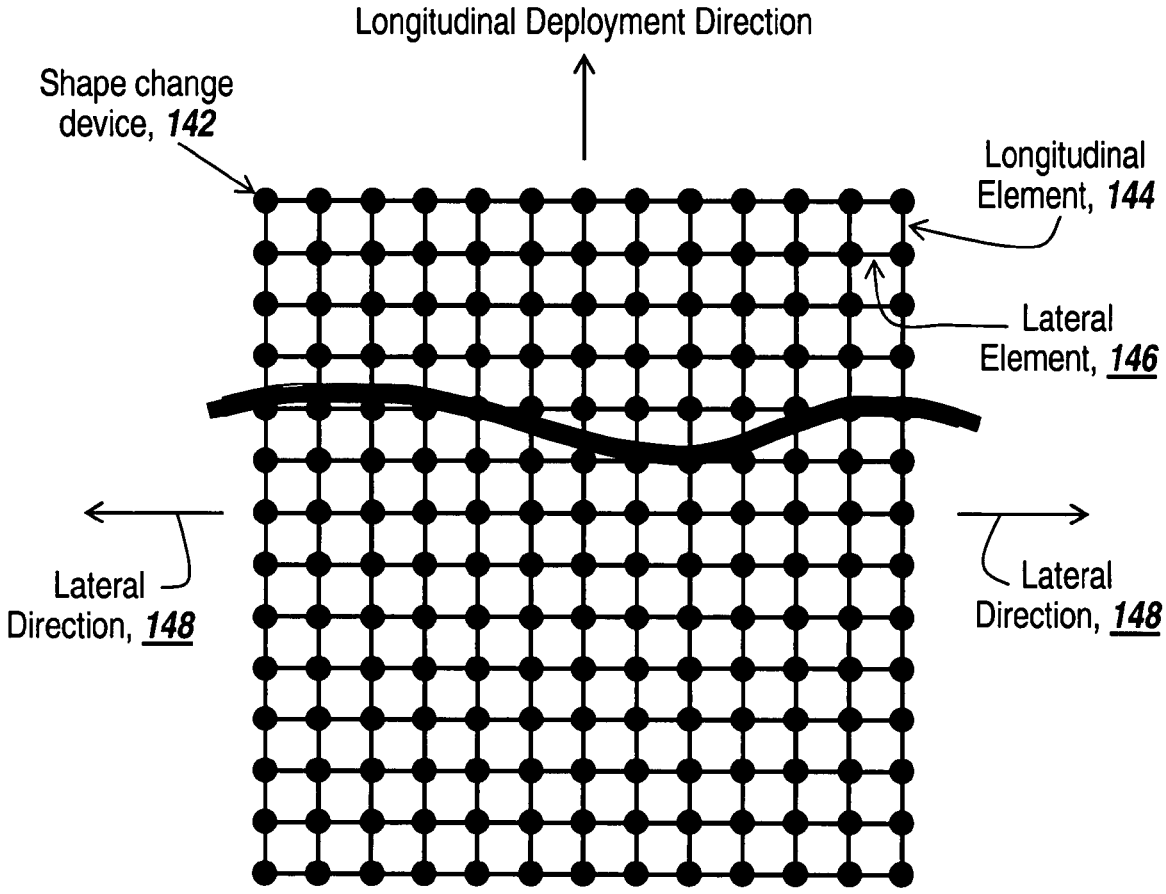
FIG. 10 is a diagrammatic illustration of the expansion of an array of munitions using either gas or liquid pneumatics.

Referring now to FIG. 10, one means of laterally expanding a folded neutralizing array 140 having shaped-charge devices 142 at the intersection of a longitudinal element 144 and a lateral element 146 is to provide pneumatic means for expanding the folded or collapsed array in the lateral direction as indicated by arrows 148.

Figure 11:
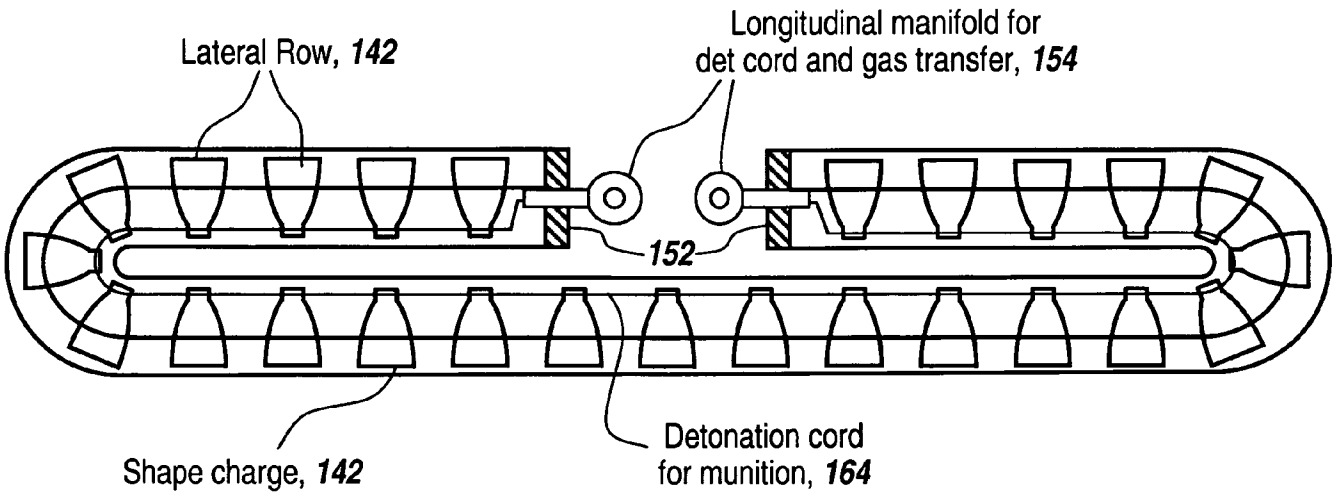
FIG. 11 is a diagrammatic illustration of the positioning of shaped charges in a reinforced lateral tube that is folded in on itself.
Figure 12:
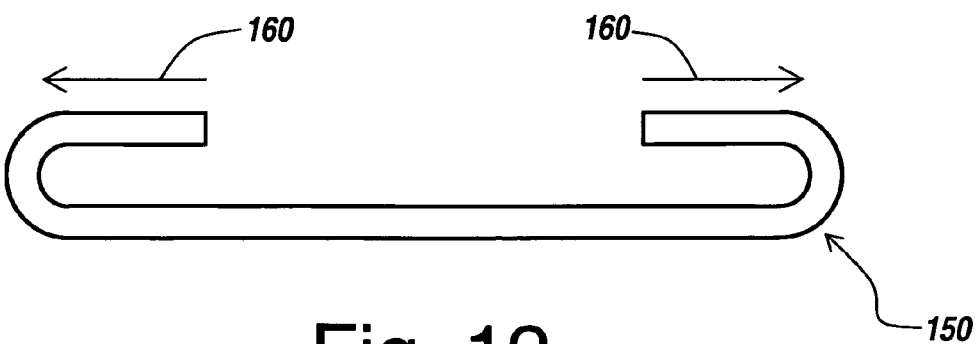
FIG. 12 is a diagrammatic illustration of the lateral deployment of the tube in FIG. 11 utilizing gas pressure.

In order to accomplish this, and referring to FIG. 11, in one embodiment each of the shaped-charge munitions 142 is captured in a sealed hose 150 that has end caps 152 and a manifold 154 for coupling of a detonation cord to the shaped charges and for igniting one or more gas-generating linear cords to rapidly generate gas pressure within the hose. This causes the lateral hoses to jump and extend to provide for the lateral extension of the hose as illustrated in FIG. 12 in the direction of arrows 160. The net interconnecting the munitions is shown at 162, whereas the detonation cord for the munitions is shown at 164.

It is the purpose of this lateral deployment technique to provide a pressurized gas within the sealed hose such that when the gas is introduced into the hose and pressurizes it, an unfolding action takes place.

The pressurization of the hose can be through the introduction of a cold gas from a gas bottle or compressor; or hot gas from a generator cartridge or a mild deflagrating gas-generating linear cord.

Figure 13:
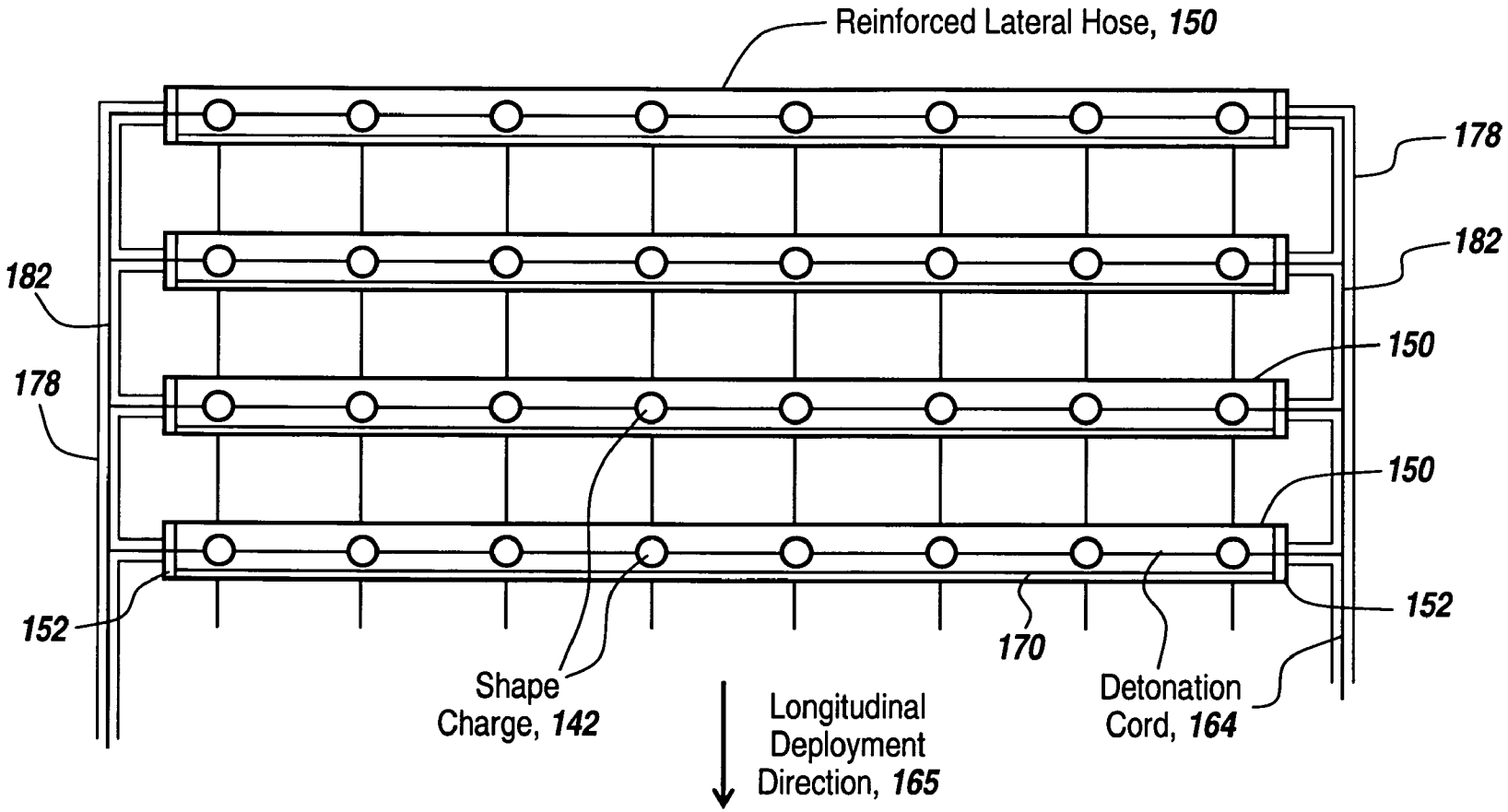
FIG. 13 is a diagrammatic illustration of a folded neutralizing array utilizing the folded tubes or hoses of FIGS. 11 and 12, illustrating the use of a linear gas-generating cord that when fired generates gas to unfold the lateral hoses to their fullest extent, in which in one embodiment the linear gas-generating cord includes a pyrotechnic shock tube; and, FIG. 14 is a cross-sectional and diagrammatic illustration of a portion of the array of FIG. 13, including illustration of pyrotechnic shock tubes within the reinforced lateral hose functioning as gas-generating linear cords as well as the same type shock tube used to transfer a detonating pulse through a longitudinal flex hose and through a flex tube transfer manifold to a gas generator initiator coupled to the gas-generating linear cord in the reinforced lateral hose.

As illustrated in FIG. 13, for the embodiment involving a linear gas-generating cord, when the array is deployed longitudinally in the direction illustrated by arrow 165, reinforced lateral hoses 150 are unfolded to the full lateral extent possible. In this figure each of hoses 150 is provided with a hose closure end cap 152 that functions as a tube bulkhead and houses a shock tube transfer manifold that distributes the pulse from a pyrotechnic shock tube to activate initiators that cause flexible shielded pyrotechnic gas generators functioning as linear gas-generating cords to generate gas within the hose.

In one embodiment shock tubes such as manufactured by Shock Tube Systems, Inc. of Sterling, Conn. are used to set off the gas-generating linear cords in the hose. The shock tube is a hollow plastic tubing, typically with a 1-mm inside diameter and a 3-mm outside diameter. The tubing is loaded with a tiny dusting of explosive powder. When initiated the explosive powder combusts and propagates down the tube at a rate of 6500 feet per second. Such a small amount of powder is used that the explosive effects are contained within the tube and the tube does not burst open. Thus the shock tube is used to convey a signal. When this signal reaches certain points along the tube it is converted into useful work such as activating a gas generator.

The shock tube has replaced electric detonators and blasting caps for many applications because it is far less sensitive to many of the effects of static electricity and radio frequency energy that can cause premature initiation of electric initiators.

Here it can be seen that a detonator cord 164 for the munitions is coupled to each of munitions 142 for the simultaneous detonation of all of the munitions in the net.

While it is possible to introduce gas under pressure into hose 150 by a number of means to unfold it, in one embodiment the gas that is utilized to rapidly fill the hose and unfold it is provided by mild deflagrating gas-generating linear cords 170 in hose 150. For redundancy two gas-generating linear cords are used and extend into the hose. When activated, the cords generate a gas overpressure that expands the hose and causes the hose to jump while at the same time causing the ends of the hose to laterally extend the array of munitions.

Figure 14:
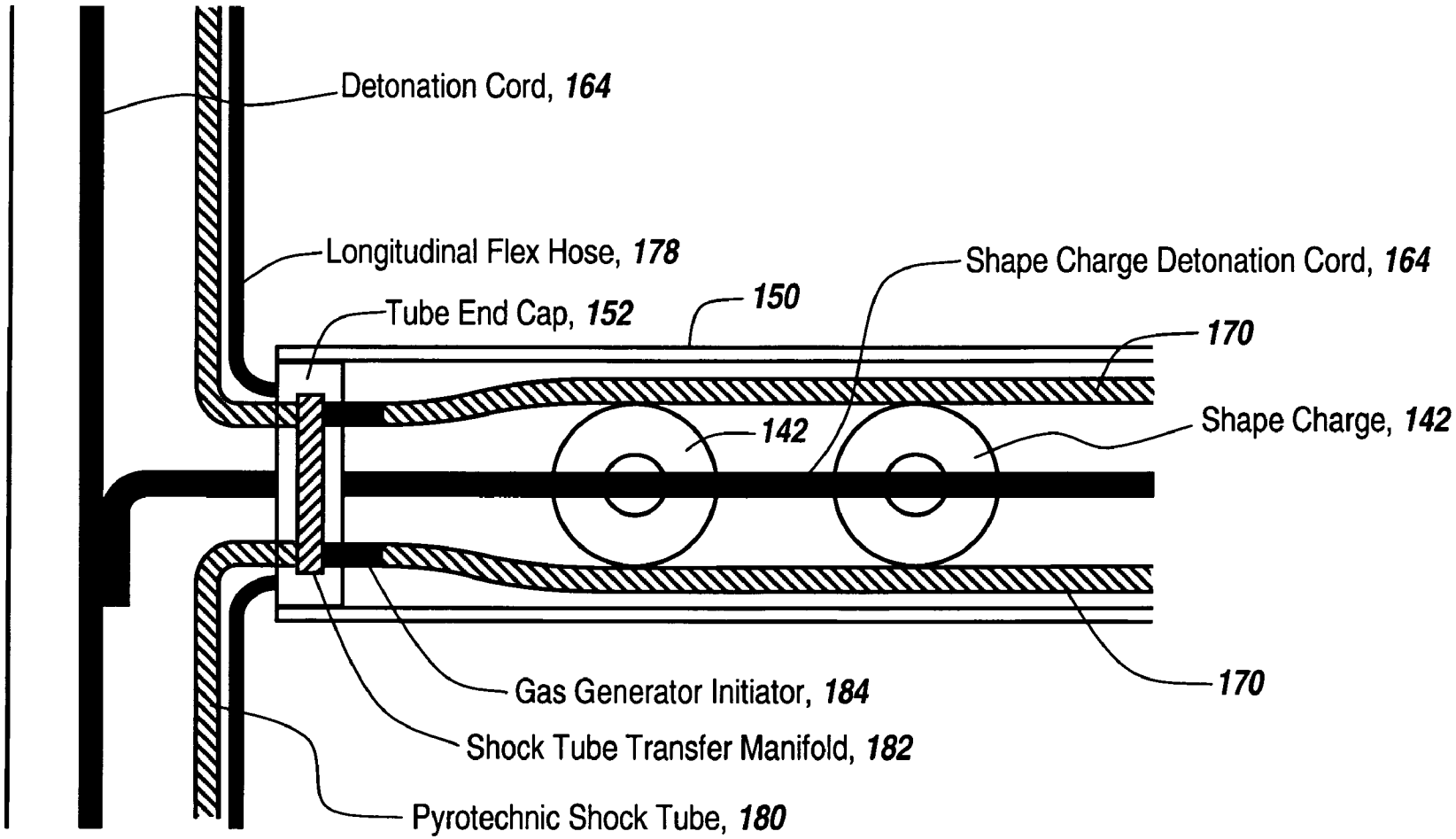

In order to activate gas-generating linear cord 170 and referring now to FIG. 14, a flexible shielded pyrotechnic shock tube 180 is coupled to end cap 152 and to a shock tube transfer manifold 182. The shock tube transfer manifold contains two gas generator initiators 184 that can be likened to detonators. When activated, these initiators initiate a reaction in the flexible shielded pyrotechnic gas generators in the form of cords 170 to release a significant amount of gas that expands tube 150.

Also passing through cap 152 and manifold 182 is the aforementioned munitions detonator cord 164, activation of which causes the munitions to detonate.

Note that the reinforced lateral hoses 150 are interconnected in one embodiment with longitudinal flexible hoses 178.

Thus, for lateral extension, gas may be introduced under pressure into the lateral hoses housing the munitions through the ignition of a gas-generating linear cord, with the pressure within the hose providing for the unfolding thereof.

Additionally, if the lateral hoses are interconnected with flexible longitudinally running hoses such as hoses 178, then the longitudinally running hoses may also be provided with the gas-generating linear cord. These hoses, too, will expand and become more rigid, thus to aid longitudinal deployment.

In summary, what is shown in one embodiment is a shock tube that feeds through the longitudinal flex hose along side the shape charge detonating cord. To laterally expand the array, the flexible shock tube is initiated to transfer a pyrotechnic shock stimulus up the length of the array without blowing itself up. At each lateral hose assembly, the shock tube enters the tube end cap and transfers its stimulus to a manifold inside the end cap. The manifold has initiators that instigate the gas generation from the linear cords within the hose. Thus in one embodiment the gas generator initiators ignite redundant flexible shielded pyrotechnic gas generator cords inside the lateral tube. This is the reaction that inflates the tube While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method of creating a cleared lane through a minefield, comprising the steps of:

deploying downwardly pointing shaped-charge munitions in an array from a ground running overpass vehicle such that the explosive force from the shaped charge munitions points downwardly into the earth, the array paying out from the back of the vehicle as the vehicle traverses a lane through the minefield so as to provide a longitudinally extending array, the array being initially compacted within a container on the overpass vehicle, and further including the step of laterally extending the array after the array exits the container by means of a pressurized fluid from a source carried by the vehicle and introduced into a conduit, with the fluid in the conduit acting on the array to extend the array so as to provide a maximally cleared width for a lane; and, detonating the munitions.

2. The method of claim 1, wherein munitions are spaced apart in the array, wherein the munitions emit shaped energy and wherein the spacing of the shaped-charge munitions is such as to preclude a mine from existing between the shaped energy from the munitions of the array.

3. The method of claim 1, wherein the extended array is wider when deployed than when the array is compacted within the container.

4. The method of claim 2, wherein the step of laterally extending the array includes providing the array with mechanical guides to spread the array upon deployment from the container.

5. The method of claim 3, wherein the step of laterally extending the array includes providing pneumatically expandable sections of the array and introducing the fluid from the conduit to expand the sections.

6. The method of claim 5, wherein the fluid includes a gas.

7. The method of claim 5, wherein the fluid includes a liquid.

8. The method of claim 5, wherein the fluid is produced by a chemical reaction.

9. The method of claim 1, wherein the array includes a number of hinged panels and wherein selected panels are initially collapsed in on each other, and further including the step of urging the collapsed-in panels outwardly after deployment from the container.

10. The method of claim 9, and further including utilizing springs to move the collapsed-in panels outwardly.

11. The method of claim 1, wherein on deployment the array is configured to orient each munition such that the blast of the munition is aimed downwardly.

12. The method of claim 1, wherein the container has an exit door, the step of deploying the shaped-charge munitions including attaching one end of the array to the exit door, jettisoning the exit door, and moving the vehicle forward after the jettison of the exit door, whereby the compacted array is pulled out of the container.

13. The method of claim 1, wherein the lateral extension of the array includes the utilization of linear elements.

14. The method of claim 13, wherein the linear elements are expanded by pressuring components thereof using compressed gas in the conduit.

15. The method of claim 13, wherein the lateral extension of the linear elements includes pressuring components thereof using gas in the conduit generated by stored chemical energy.

16. The method of claim 1, wherein the lateral extension of the array includes utilizing collapsible lateral tubular elements.

17. The method of claim 1, wherein the array is deployed utilizing application of the movement of the vehicle and the force of gravity.

18. The method of claim 1, wherein the lateral extension includes utilizing an active spreading mechanism including the pressurized fluid in the conduit.

19. The method of claim 1, wherein the vehicle is an unmanned vehicle.

20. The method of claim 1, wherein the vehicle is a robotically controlled vehicle.

21. A method of creating a cleared lane through a minefield, comprising the steps of:

deploying shaped-charge munitions in an array from an overpass vehicle as the vehicle traverses a lane through the minefield so as to provide a longitudinally extending array, the munitions being incorporated into the array and the array being compacted into a container on the vehicle, the container having an exit door, the step of deploying the shaped-charge munitions including attaching one end of the array to the exit door, jettisoning the exit door, and moving the vehicle forward after the jettison of the exit door, whereby the compacted array is pulled out of the container, and, detonating the munitions.

* * * * *